United States Patent [19]

Slone

[11] 4,036,407

[45] July 19, 1977

[54] DOSING VALVE

[75] Inventor: Thomas James Slone, Cincinnati, Ohio

[73] Assignee: The Procter & Gamble Company, Cincinnati, Ohio

[21] Appl. No.: 670,587

[22] Filed: Mar. 26, 1976

[51] Int. Cl.[2] ..... E03D 9/03

[52] U.S. Cl. ..... 222/188; 222/453; 4/227; 4/228

[58] Field of Search ..... 222/453, 188, 56, 57; 4/227, 228, 222, 230, 231, 232

[56] References Cited

U.S. PATENT DOCUMENTS

| | | | |
|---|---|---|---|
| 1,454,572 | 5/1923 | Walters | 222/453 X |
| 2,587,388 | 2/1952 | Ryder | 4/227 |
| 2,689,669 | 9/1954 | Ericson | 222/453 X |
| 3,841,524 | 10/1974 | Easter | 222/453 X |
| 3,908,209 | 9/1975 | Fillmore | 4/227 |

*Primary Examiner*—Robert B. Reeves
*Assistant Examiner*—Frederick R. Handren
*Attorney, Agent, or Firm*—Thomas J. Slone; John V. Gorman; Richard C. Witte

[57] ABSTRACT

An improved dosing valve for use in beverage dispensers, toilet tank additive dispensers, and the like which dispensers comprise substantially rigid reservoirs. The improved valve comprises an air-lock seal and another seal which may also be an air-lock seal. Dosing valves comprising such air-lock seals are particularly effective for obviating leakage of low viscosity, low surface tension, wetting type products such as toilet tank disinfectants comprising surfactant material. The seals are so disposed that the valve will dispense a metered dose of a liquid product from its associated reservoir each time a moveable component moves from an UP position to a DOWN position, and a dose-volume of air will be vented into the dispenser reservoir each time the moveable component is moved from its DOWN position to its UP position. The moveable member can be moved upwardly either mechanically, or by virtue of being buoyant, and it can be moved downwardly by gravity alone or by gravity supplemented by biasing means. For instance, such a valve comprising a buoyant moveable member will, if incorporated in a toilet tank additive dispenser, cause a metered dose of a liquid product to be dispensed each time the toilet tank is emptying during a toilet flushing event; and vent a dose-volume of air into the dispenser's reservoir when the toilet tank is refilled.

14 Claims, 13 Drawing Figures

DOSING VALVE

FIELD OF THE INVENTION

This invention generally relates to providing dosing valves having a moveable component for use in liquid-product dispensers to provide a metered discharge each time the valve is operated. For instance, such valves in which the mechanical component is manually displaced upwardly and, when released, gravitates downwardly are useful in beverage dispensers and the like. Also, such valves in which the moveable component is buoyant, are useful for automatically dispensing a metered dose of a liquid product such as a toilet disinfectant into a toilet tank each time the toilet is flushed so that the bowl of the toilet is subjected to the action of the liquid product. Moreover, such valves which dispense toilet tank additives in response to a receding water level (i.e., when the toilet is flushed) as opposed to responding to a rising water level (i.e., toilet tank filling) provide a higher residual concentration of product in the toilet bowl between flushes.

DESCRIPTION OF THE PRIOR ART

Toilet tank additive dispensers comprising dosing valves having buoyant moveable spool-like components are disclosed in U.S. Pat. No. 3,841,524 which issued Oct. 15, 1974 to Avard Joseph Easter, and U.S. Pat. No. 3,908,209 which issued Sept. 30, 1975 to William E. Fillmore. The valve structures disclosed in these patents comprise, positive contacting type seals, and members having sliding fits between them. However, such contacting seals and sliding-fit seals require precision fits to be effective; especially in view of the low forces involved; that is, the weight of the moveable valve component acting with the product head to effect sealing at the DOWN position; and the net buoyancy of the moveable valve component to effect sealing in the UP position. Such seals are not entirely effective or suitable for use with liquid products having low viscosity and/or low surface tension. The air-lock seals of the improved dosing valve comprising the present invention effectively seal without the valve parts being biased together in contacting relation. Thus, they do not require precision mating, contacting fits; and are particularly effective with respect to obviating leakage of low viscosity, low surface tension, wetting type liquid products. Moreover, the improved valve of the present invention incorporates air-lock seals in valve constructions which incrementally provide positive air replacement in the reservoir as liquid product doses are incrementally dispensed therefrom.

U.S. Pat. No. 3,698,021 which issued Oct. 17, 1972 to Frank Joseph Mack, et al., discloses a dosing valve construction for dispensing a metered dose of a liquid product into a toilet tank being filled; that is, while the water level in the toilet tank is rising. The disclosed valve comprises an air-lock seal and a contact seal but the valve does not comprise means for incrementally providing positive air replacement in the reservoir as liquid product doses are incrementally dispensed therefrom as is provided by the present invention.

To summarize, the referenced prior art does not disclose a dosing valve construction which solves the problems of positive sealing, accurate dose metering, and positive venting or air replacement in the manner of nor the degree provided by the present invention.

OBJECTS OF THE INVENTION

The nature and substance of the present invention will be more readily appreciated after giving consideration to its major aims and purposes. The principal objects of the invention are recited in the ensuing paragraphs in order to provide a better appreciation of its important aspects prior to describing the details of several embodiments of the invention in later portions of this specification.

A major object of the present invention is to provide a dosing valve comprising an air-lock seal and a moveable component, which dosing valve will, when incorporated in a dispenser containing a quantity of a liquid product, dispense a metered dose of the liquid product each time the moveable component is moved to a DOWN position, and which will positively vent a dose-volume of air into the dispenser when the moveable component is moved to an UP position.

Another major object of the invention is providing the dosing valve described in the preceding paragraph wherein the air-lock seal is effective when the moveable component is at its DOWN position whereby the valve is particularly effective in obviating leakage of low viscosity, low surface tension, wetting-type liquid products such as toilet tank disinfectants comprising surfactant material, even in the event the moveable component remais at the DOWN position for extended periods of time.

Still another object of the present invention is providing the dosing valve described in the preceding paragraphs wherein the moveable member can be moved upwardly manually whereby the valve is particularly useful in a beverage dispenser, or wherein the moveable member is sufficiently buoyant to be buoyed upwardly when partially immersed in a body of liquid external the dispenser whereby the valve is particularly useful in toilet tank additive dispensers and the like.

A further object of the present invention is providing the dosing valves described in the preceding paragraphs but which valves comprise two air-lock seals, and which valve will meter, isolate, and dispense a metered dose of a liquid product from the dispenser each time the moveable component moves from an UP position to a DOWN position, and will positively vent a dose-volume of air upwardly into the dispenser each time the moveable member is moved from its DOWN position to its UP position.

Yet still another object of the present invention is providing the dosing valve constructions described in the preceding paragraphs but which each further comprise a contacting type shipping seal.

SUMMARY OF THE INVENTION

The above and other objects are achieved in accordance with one aspect of the present invention by providing an improved dosing valve for use in a dispenser containing a quantity of a liquid product, which valve comprises a stationary member and a moveable member, and which moveable member is manually moveable upwardly and moveable downwardly by gravity between UP and DOWN positions respectively. The improvement comprises means for forming an air-lock seal, and an other seal intermediate the stationary member and the moveable component when the moveable component is disposed at its DOWN and UP positions respectively. The improvement further comprises means cooperatively associated with the seals for metering and dispensing a metered dose of liquid product from the reservoir of the dispenser each time the moveable component gravitates downwardly from its UP position to its DOWN position, and for metering a dose-volume of air upwardly into the reservoir of the dispenser each time the moveable component is moved upwardly from its DOWN position to its UP position.

The other seal of the improved dosing valve may also be an air-lock seal. The air-lock seals may comprise elements of the moveable component which are adapted to be telescoped into or about portions of the stationary member. The air-lock seals may be adapted to have overlapping sealing ranges for providing make-before-break action to assure positive isolation of a metered dose from the remainder of the liquid product in the dispenser before the metered dose is dispensed or discharged from the dispenser. The movable component may further comprise means for being sufficiently buoyant that the valve will respond to an alternately rising and receding level of a second liquid (e.g.: water in a toilet tank) so that a dose of the product will be dispensed each time the level of the second liquid recedes sufficiently to enable the moveable component to gravitate from its UP position to its DOWN position. The improved dosing valve may still further comprise means such as a releaseably latchable contacting-type seal having contacting sealing surfaces for providing a shipping seal. Moreover, the moveable component of the improved dosing valve may also comprise two parts, and means for telescoping the two parts relative to each other to provide a relatively short shipping configuration and a relatively long dispensing configuration, and means for activating the valve by first pulling outwardly on the moveable component with respect to the dispenser to extend its length to the dispensing configuration, and then pushing it inwardly to unlatch the shipping seal.

DESCRIPTION OF THE PREFERRED EMBODIMENTS

The several dosing valve embodiments of the present invention are described herein with frequent reference to being incorporated in toilet tank additive dispensers. It is not intended to thereby limit, however, the present invention.

Figure 1:
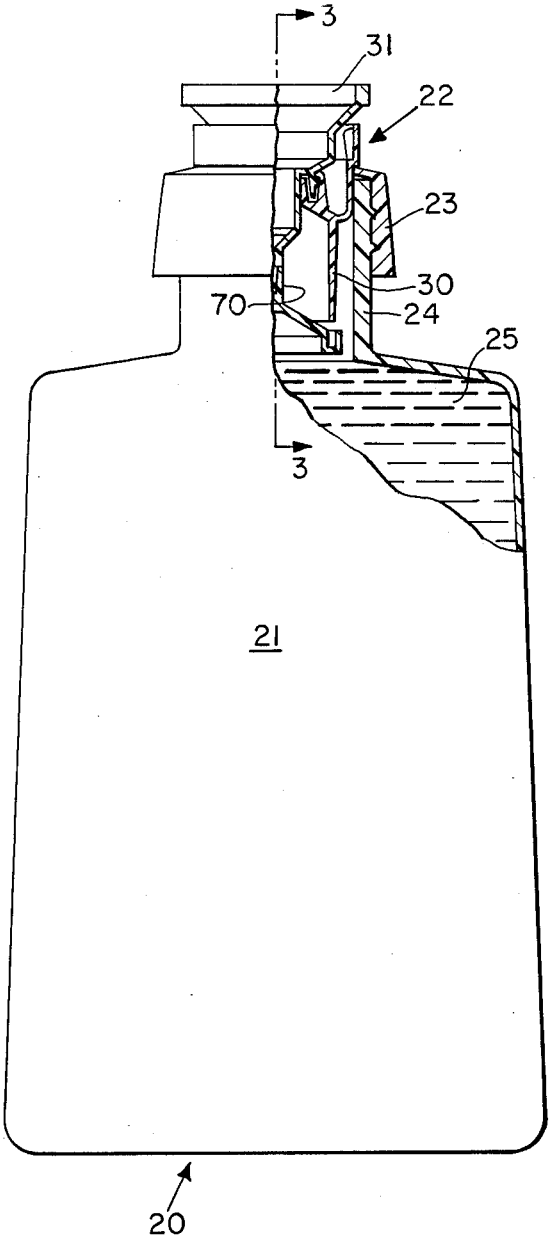
FIG. 1 is a partially broken away, frontal view of a dispenser comprising an improved duplex air-lock-seal dosing valve which embodies the present invention.

Referring now to the drawings, FIG. 1 shows a dispenser 20 comprising a substantially rigid reservoir 21, an improved duplex air-lock-seal dosing valve 22, and a threaded retaining collar 23 for securing valve 22 in the externally threaded neck 24 of reservoir 21. The reservoir is adapted to hold a quantity of a liquid product 25.

Figure 2:
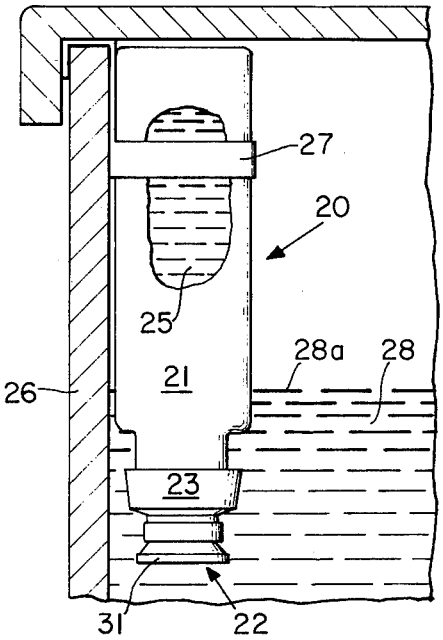
FIG. 2 is a fragmentary view of a toilet tank having the dispenser of FIG. 1 inverted and secured therein, and with the improved dosing valve of the present invention immersed in water disposed in the toilet tank.

FIG. 2 shows dispenser 20 inverted and secured in a toilet tank 26 by securement means such as a bracket 27 so that the then lowermost portion of valve 22 is immersed when the toilet tank 26 is full of water 28, the FULL level being designated 28*a*. Proper mounting of the dispenser 20 further requires that the valve 22 not be immersed when the toilet tank 26 is substantially empty (i.e.: at the low water level during a toilet flushing event).

Figure 3:
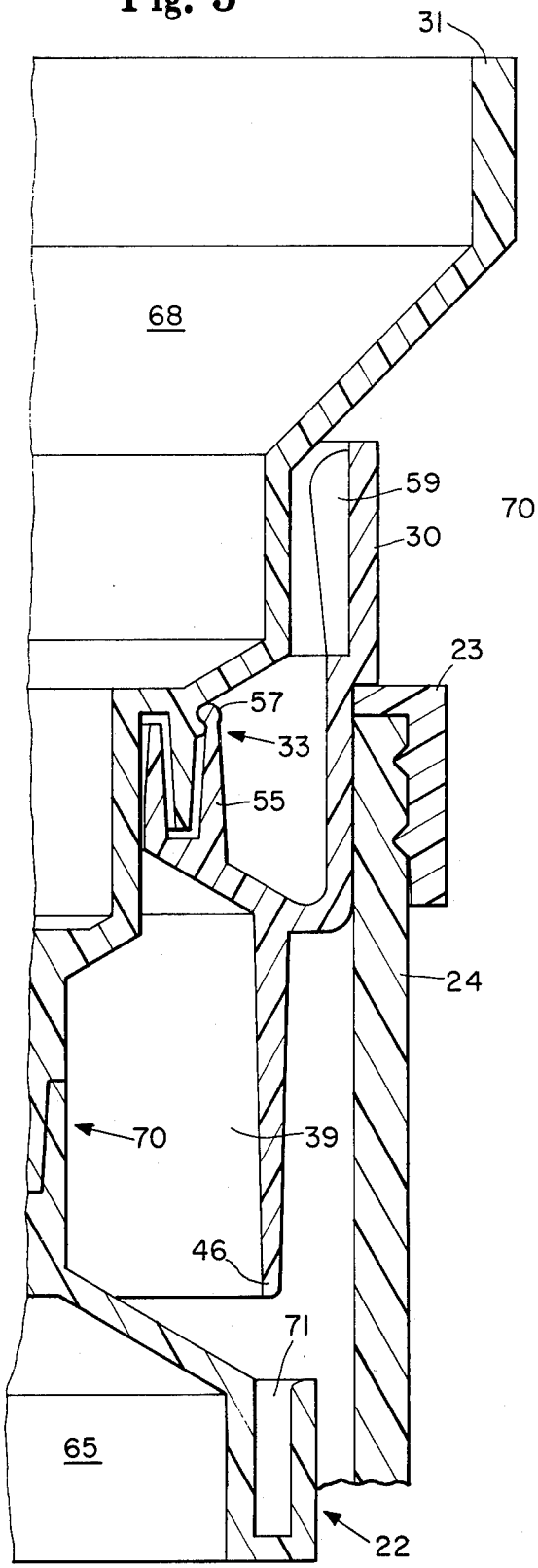
FIG. 3 is an enlarged scale, fragmentary sectional view of the dispenser and improved dosing valve shown in FIG. 1 taken along line 3—3 thereof.

FIG. 3 shows, in enlarged scale, a sectional view of the improved dosing valve 22 taken along line 3—3 of FIG. 1. Valve 22 comprises a stationary member 30, and a moveable component 31 which is axially moveable with respect to the stationary member 30. Both the stationary member 30 and the moveable component 31 are bodies of revolution about vertical coextensive axes not shown in the figures.

Figure 5:
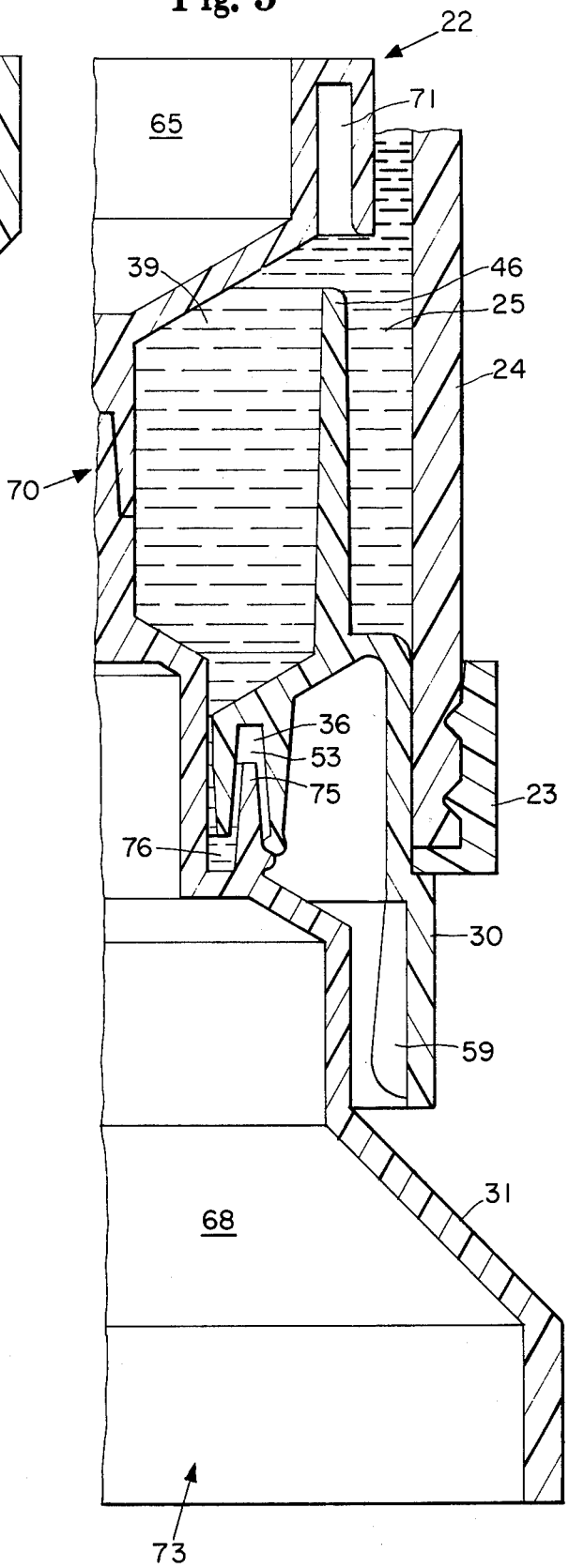
FIG. 5 is a fragmentary sectional view of the dispenser, and improved dosage valve of FIG. 4 with the moveable component of the valve disposed at its UP position.
Figure 6:
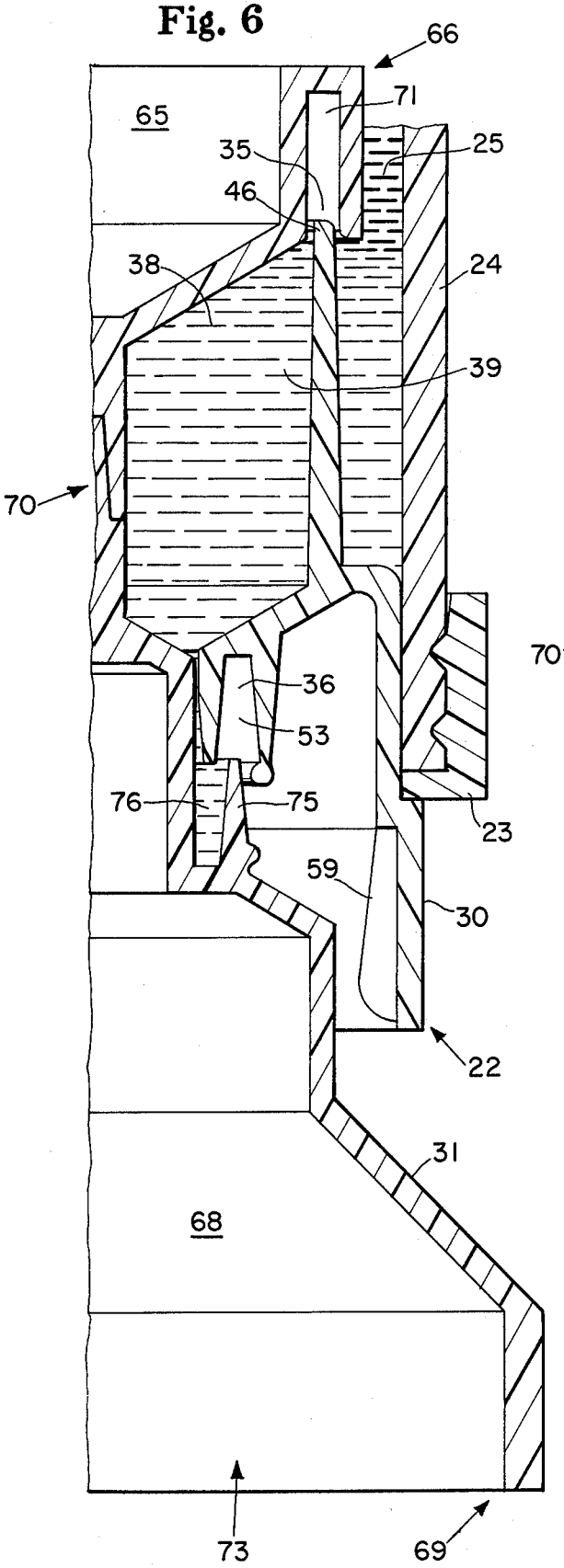
FIG. 6 is a fragmentary sectional view of the dispenser, and improved dosing valve of FIG. 5 with the moveable component of the valve moved downwardly to an intermediate, dose-isolating position.
Figure 4:
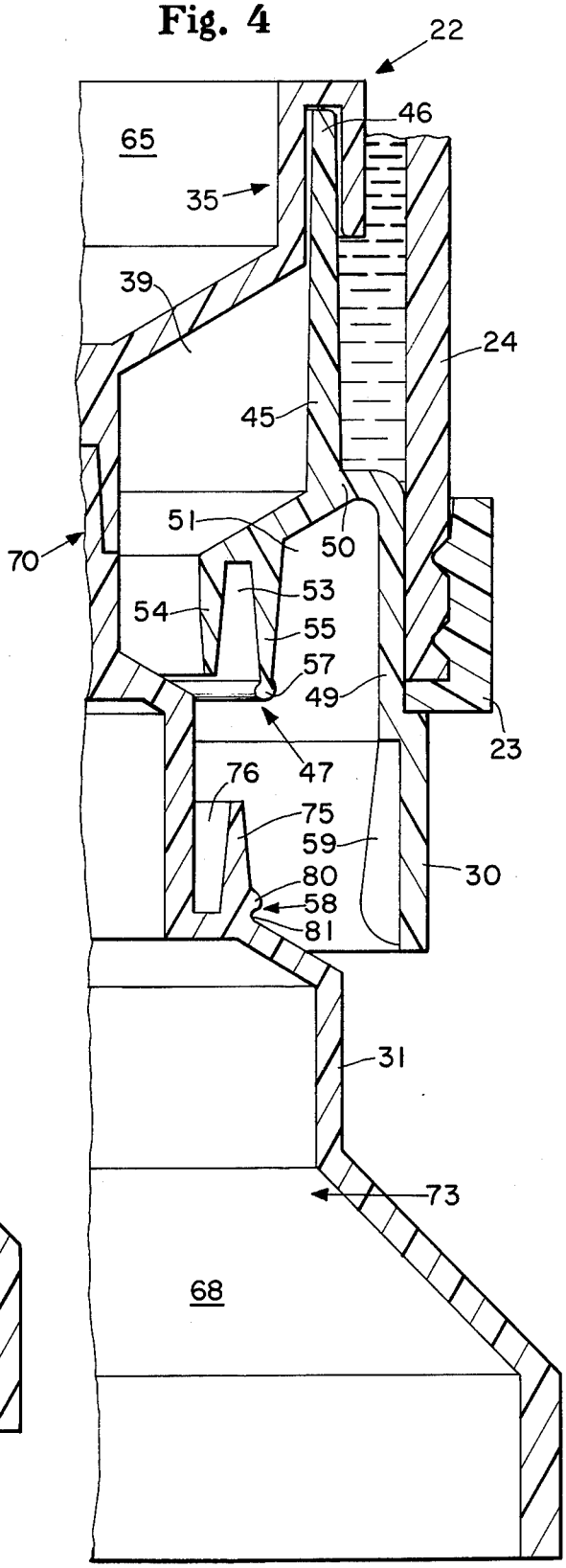
FIG. 4 is an inverted, fragmentary sectional view of the dispenser, and improved dosing valve of FIG. 1 which is shown with the moveable component of the valve disposed at its DOWN position.

Briefly, valve 22 comprises a releaseably latchable shipping seal 33, FIG. 3, comprising cooperating contacting sealing means which shipping seal is shown latched in FIG. 3, and unlatched in FIGS. 4 through 6 inclusive. Stationary member 30 is sealingly secured in the neck 24 of reservoir 21 and/or the retaining collar 23; for instancd, by virtue of comprising sufficiently resilient material such as polypropylene or polyethylene and by virtue of having a sufficient interference fit in the retaining collar 23, or in the neck 24 of reservoir 21. Reservoir 21 may comprise glass or other substantially rigid material; for instance, polycarbonate or acrylonitrile. The moveable component 31 comprises means for being sufficiently buoyant to hold the moveable component 31 at its UP position, FIG. 5, when its lower portion is immersed in a second liquid (not shown in FIG. 5); for instance, the water 28 in the toilet tank 26, FIG. 2. Upon flushing the toilet (not shown), the water level will recede and the moveable component 31 will gravitate downwardly through an intermediate position, FIG. 6, and then to its DOWN position, FIG. 4. At the intermediate position, FIG. 6, a first air-lock seal 35 and a second air-lock seal 36 are both sealed and cause a metered dose 38 of liquid product 25 to be isolated in a dose chamber 39 from the remainder of the liquid product 25 disposed in the reservoir. Then, as the moveable member gravitates to the DOWN position, FIG. 4, the second (lower) air-lock seal 36 is broken and the metered dose 38 of product gravitates downwardly and out of the dispenser. As the toilet tank is refilled, a dose-volume of air is metered upwardly into the reservoir and the dose chamber 39 is refilled with liquid product 25 as the moveable component 31 is buoyed upwardly past the intermediate position, FIG. 6, and thence to the UP position, FIG. 5.

Referring now to FIG. 4, the stationary member 30 of valve 22 is a body of revolution about a vertical axis (not shown) which member 30 comprises a tubular portion 45 having a top end 46 and a bottom end 47, and an annular-shape skirt 49 which extends downwardly from a juncture 50 at an intermediate elevation of the tubular portion 45. Thus, an annular-shape first vault 51 is formed intermediate the skirt 49 and the bottom end 47 of tubular portion 45. Moreover, in the preferred embodiment valve 22 shown in FIG. 4, the bottom end 47 of the tubular portion 45 has a downwardly facing annular channel 64 formed between an annular inner rim 54 and an annular outer rim 55. The downwardly facing channel 53 is alternatively designated an annular-shape second vault. Thus, the stationary member 30 comprises means for defining an annular-shape vault adjacent the bottom end 47 of the tubular portion 45.

Still referring to FIG. 4, the distal edge 57 of the outer rim 55 is bead-shaped or otherwise configured to coact with a portion designated 58 of the moveable component 31 to releaseably latch them together so that adjacent circumferentially extending portions thereof are in sealing contact. This provides the shipping seal 33 which is shown in FIG. 3 disposed in the latched and sealed position, and which shipping seal will be described more fully hereinafter.

The stationary member 30, FIGS. 3–6, further comprises a plurality of circumferentially spaced guide ribs 59 for limiting potential sideways motion of the moveable component 31.

The moveable component 31, FIG. 4, comprises a top part 65 having an upper end 66, a bottom part 68 having a lower end 69. The top part 65 and the botttom part 68 have stem-forming portions which are secured together in telescoped relation to form a stem 70. The upper end 66 of the top part 65 has a downwardly opening annular-shape channel 71, FIG. 5, formed in it which channel 71 is sized and configured to telescope downwardly over the tubular top end 46 of the stationary member 30 to form the first air-lock seal 35 as shown in FIGS. 4 and 6.

The bottom part of the moveable component 31, FIG. 4 comprises an air-bell 73 which has a sufficiently large, downwardly opening air chamber to make the moveable component 31 buoyant when used in an inverted dispenser such as the toilet tank additive dispenser 20, FIG. 2.

The bottom part 68 of the moveable component 31, FIG. 4, also comprises an upwardly extending tubular section 75 which defines an upwardly facing annular U-shape channel 76 between the tubular section 75 and the adjacent portion of the moveable component 31 spaced radially inwardly therefrom. The tubular section 75 is so sized, configured and disposed that, when the moveable component 31 moves upwardly, the tubular section 75 telescopes into the second vault 53 of the stationary member 30 while the U-shape channel 76 concurrentluy telescopes over the inner rim 54 of the stationary member 30. This telescoping action is shown sequentially in FIGS. 4, 6, and 5, and forms the second air-lock seal 36, FIGS. 5 and 6.

The moveable component 31, FIG. 4, also comprises means for being releasably latched to the stationary member to form the contact type seal therebetween as previously described hereinbefore and designated shipping seal 33, FIG. 3. This means comprises, for instance, a radially outwardly projecting annular-shape bead 80, FIG. 4, having a radially inwardly extending annular-shape groove 81 immediately below it. Thus, the bead on the distal edge 57 of the outer rim 55 of the stationary member 30 can be snapped over the bead 80 on the moveable member 31, and be sealingly seated in the annular-shape groove 81 on the moveable member 31; reference FIG. 3.

Of course, such releasably latchable shipping seals must be configured to require a greater force to latch them than the normal forces encountered during dispensing operations: i.e., either buoyancy (upward force) or weight (downward force) of the moveable component. Otherwise, such shipping seals might latch during dispensing operation of the valve and thereby cause the valve to cease operating. That is, for instance, to cease automatically dispensing doses of product in response to flushing a toilet.

The preferred embodiment dosing valve 22, FIGS. 3–6, is preferably activated, installed, and operated, when incorporated in a toilet-tank-additive dispenser 20 as shown in FIG. 1, and with the shipping seal 33 latched as shown in FIG. 3, by holding the dispenser 20 upright, FIG. 1, and pulling upwardly on the moveable component 31 (i.e., the air bell) to unlatch the shipping seal 33, FIG. 3, and to extend the moveable component 31 to the FIG. 4 (but upright) position. Then the dispenser 20 is inverted and secured in the toilet tank 26 as shown in FIG. 2. When first inverted, the moveable component will be held by gravity in the FIG. 4 position. As the valve end of the dispenser is immersed in the water 28 in the toilet tank upon installing the dispenser therein, the moveable component 31 will be buoyed upwardy to the FIG. 5 position at which time the dose chamber 39 will be filled with product 25. Then, when the toilet is flushed and the water level in the tank recedes below the bottom of the moveable component 31, the moveable component 31 will gravitate downwardly through the intermediate position, FIG. 6, and to the DOWN position, FIG. 4.

As can best be seen in FIG. 6, the air-lock seal forming portions of the stationary member 30 and the moveable component 31 which form air-lock seals 35 and 36 have sufficient axially extending lengths to provide positive overlapping action of the two air-lock seals 35 and 36. This action isolates a metered dose 38 of the liquid product in the dose chamber 39 from the remainder of the product 25 before the metering dose 38 is dispensed. Such overlapping action of the seals is hereinafter referred to as make-before-break action.

The metered dose 38, FIG. 6, is dispensed by gravitating downwardly out of the dose chamber as the moveable component moves downwardly to the DOWN position, FIG. 4, leaving a relatively negligible residual volume of product in the U-shape channel 76. As the metered dose is dispensed, the dose chamber 39 fills the air. Subsequently, when the toilet tank is refilled, the moveable component 31 is buoyed upwardly from the DOWN position, FIG. 4, through the intermediate position, FIG. 6, and thence to the UP position, FIG. 5. In doing so a dose-volume of air is released from the dose chamber 39 into the reservoir 21.

Of course, as will be understood by persons of ordinary skill in the art without exhaustive explanation, the operation of the air-lock seals requires the reservoir 21 to be substantially rigid, and unvented except through the dosing valve 22. That is, when the dispenser is inverted as in FIG. 2, a pressure differential develops across the air-lock seals with a partial vacuum in the reservoir and a higher, ambient pressure outside the reservoir. Thus, the trap-shape geometry of the air-lock seals enables the ambient pressure outside the reservoir to support the column of product 25 within the reservoir. This enables the valve to incrementally dispense metered doses of liquid product from the reservoir, and to alternately incrementally replace the dispensed product with dose-volumes of air.

ALTERNATE EMBODIMENTS

In order to minimize redundant descriptions, several alternate embodiments of the present invention will be described from the viewpoint of their differences from the preferred embodiment valve construction 22, FIGS. 3–6. Features, parts, elements, and the like having similar functions as in dispenser 20 and valve 22, are designated by three digit numbers having the same last two digits as their respective counterparts. For instance, wherease the preferred dosing valve is designated 22, the first alternate dosing valve is designated 122, the second alternate dosing valve is designated 222, and so forth.

Figure 7:
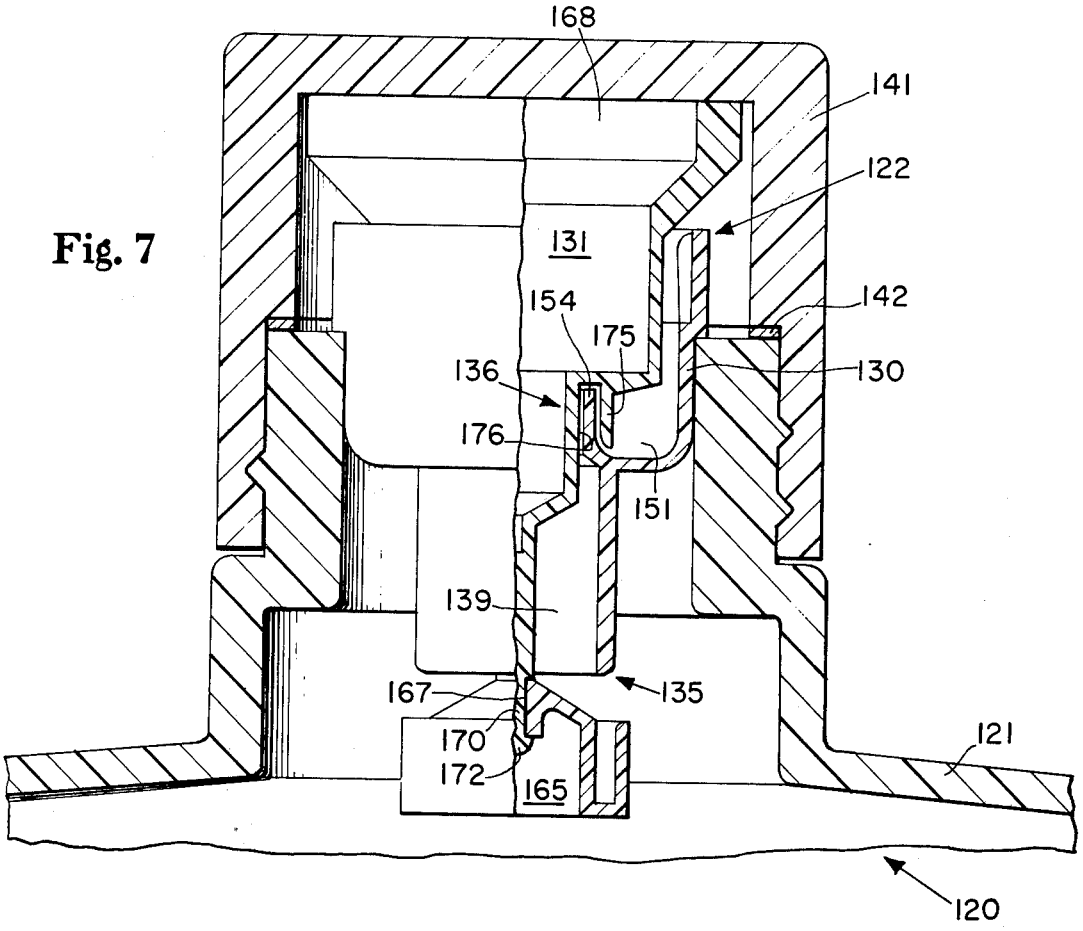
FIG. 7 is a fragmentary, partially broken away view of another upright (valve end up) dispenser which dispenser comprises an alternate, improved duplex air-lock-seal dosing valve embodiment of the present invention.

The first alternate dosing valve construction 122 is shown in FIG. 7 in an upright (valve end up) dispenser 120. Valve 122 does not comprise a releasably latchable shipping seal comparable to shipping seal 33, FIG. 3, nor does the stationary member 130 have an outer rim or second vault comparable to outer rim 55 and second vault 53, FIG. 3, of the preferred embodiment dosing valve 22. Therefore, dispenser 120, FIG. 7, is sealed for shipping by providing a threaded cap 141, and a gasket 142. Valve 122 does comprise, however, means for forming first and second air-lock seals 135 and 136 respectively. The first air-lock seal 135 is like the first air-lock seal 35 in the preferred embodiment valve construction 22, whereas, the second air-lock seal 136 of valve 122 is formed by the inner rim 154 of the stationary member 130 extending into the U-shape channel 176 of the moveable component 131, when the dispenser is in its inverted, dispensing orientation and by the tubular section 175 of the moveable component 131 extending into the annular-shape vault 151. Valve 122 also comprises an alternate manner of securing the two parts of the moveable component 131 together. That is, top part 165 is provided with a centrally disposed, axially extending hole through which a reduced diameter cylindrical portion of the stem is telescoped, and subsequently reshaped in a rivet-like manner to provide a head 172.

Figure 8:
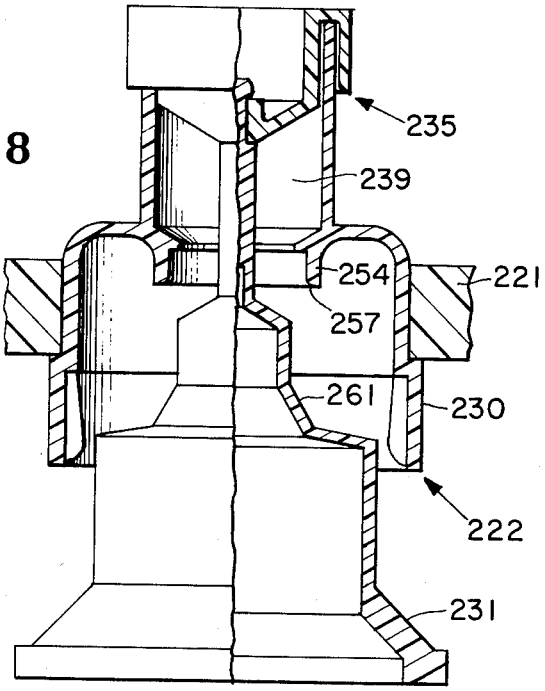
FIG. 8 is a fragmentary, partially broken away view of yet another dispenser which is inverted (valve end down), which alternate dispenser comprises yet another alternate dosage valve embodiment of the present invention.

Another alternate dosing valve 222 embodiment of the present invention is shown in FIG. 8 to comprise an air-lock seal 235 at the top only, and a contacting type seal at the bottom. The bottom seal would be formed intermediate the distal edge 257 of rim 254 of the stationary member 230 and the truncated conical surface 261 of the moveable component 231 when the moveable component 231 is buoyed to its UP position. The air-lock seal 235 is, as compared to a contact type seal, particularly effective in obviating leakage of low surface tension liquid products and the like when the moveable member is disposed at the DOWN position, the position shown in FIG. 8, as for instance when the toilet tank fails to refill promptly, and, as for instance when this sealing arrangement is utilized in a beverage dispenser such as will be discussed in conjunction with the next succeeding alternate dosing valve construction 322, FIG. 9.

Figure 9:
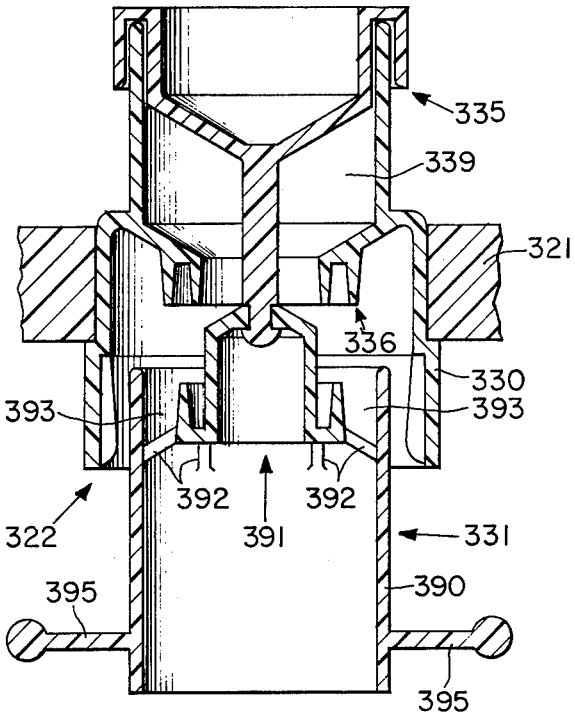
FIG. 9 is a fragmentary sectional view of still another dispenser comprising a manually operable, duplex air-lock-seal dosing valve embodiment of the present invention.

A duplex air-lock-seal beverage dispenser valve 322 embodying the present invention is shown in FIG. 9 in its operating orientation. The valve comprises a stationary member 330 and a moveable component 331 but does not comprise a releasably latchable shipping seal comparable to shipping seal 33, FIG. 3, nor buoyant means such as an air bell. Rather, the moveable component 331 comprises a tubular skit 390 which is supported from the central portion 391 of the moveable component 331 by a plurality of circumferentially spaced struts 392. Thus, fluid passageways 393 are provided between the struts 392. The lower portion of the tubular skirt 390 of the moveable component 330 is also fitted with a plurality of radially outwardly extending, cantilevered actuator arms 395.

The duplex air-lock-seal beverage dispenser valve 322 is shown in FIG. 9 with its moveable component 331 at its DOWN position. A top or first air-lock seal 335 obviates leakage in this position. In operation, the rim of a container (not shown) such as a glass or cup is urged upwardly against the cantilevered actuator arms 395 to displace the moveable component 331 to its UP position whereat the dose chamber 339 is filled with a metered dose or serving portion of the liquid product. At the UP position, leakage is obviated by the lower or second air-lock seal 336 as described hereinbefore. Then, upon lowering the container, the moveable component 331 will gravitate downwardly and release the metered dose or portion of liquid product from chamber 339. The released volume of liquid product then flows downwardly through passageways 393 and thence into the container via the inside of the tubular skirt 390 of moveable component 331.

Yet another alternate embodiment dosing valve 422 is shown in FIGS. 10–13 inclusive. As compared to the preferred dosing valve 22, FIGS. 3–6, valve 422 comprises two releasably latchable shipping seals 433*a* and 433*b*, and the two parts 465 and 468 of its moveable component 431 are provided with telescoping portions generally designated 498 to provide a relatively short shipping length for the moveable component, FIG. 10, and means for releasing the shipping seal 433*a* and extending the length of the moveable component to its longer operating length by first pulling outwardly on the moveable component 431 with respect to the reservoir 421, FIG. 11, and then pushing the moveable component 431 inwardly to effect unlatching the top shipping seal 433*b*.

Figure 10:
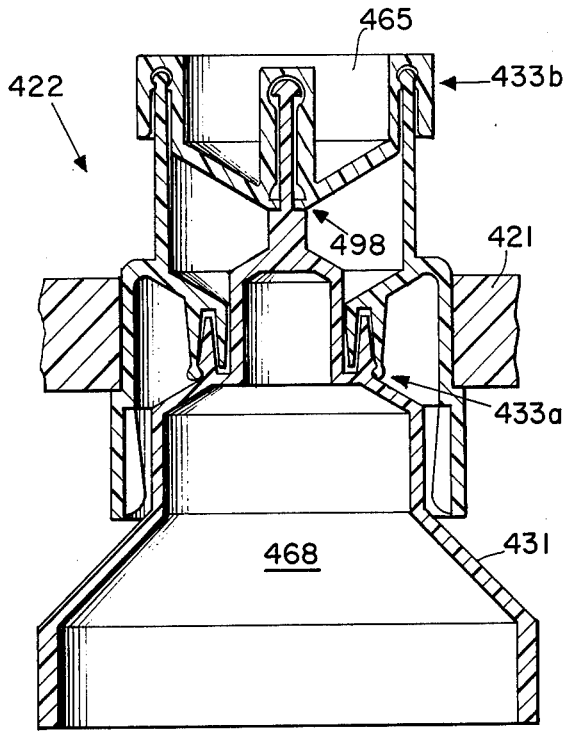
FIGS. 10 through 13 inclusive are fragmentary, sectional, sequential views of still yet another dispenser embodying yet another alternate improved duplex air-lock-seal dosing valve having a two part moveable component disposed at its shipping, extended, UP, and DOWN positions respectively.
Figure 11:
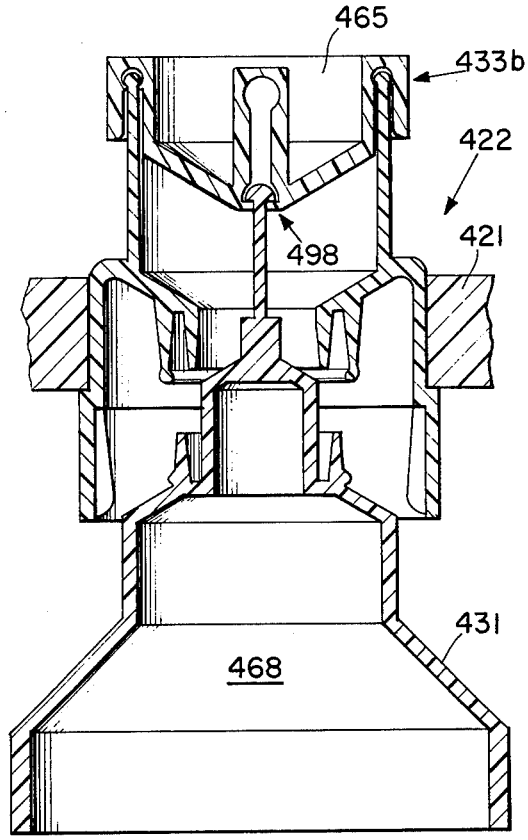
Figure 12:
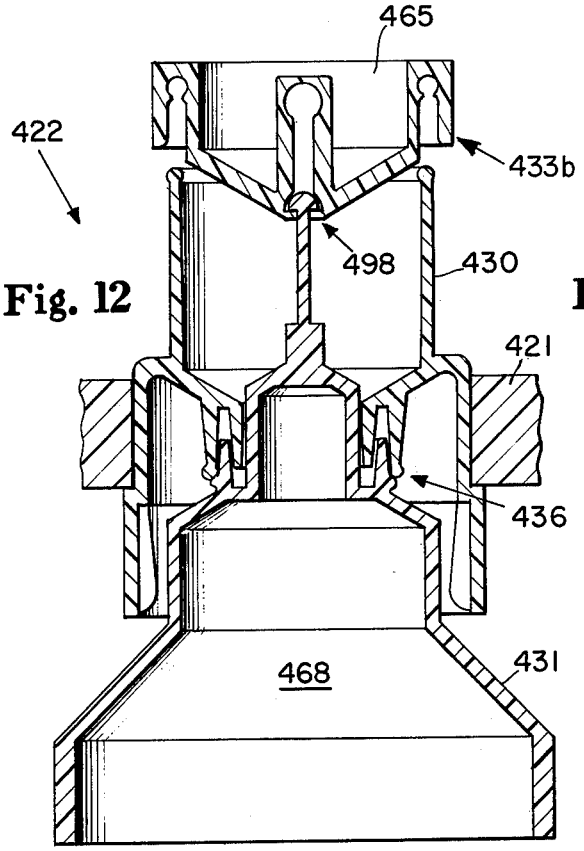
Figure 13:
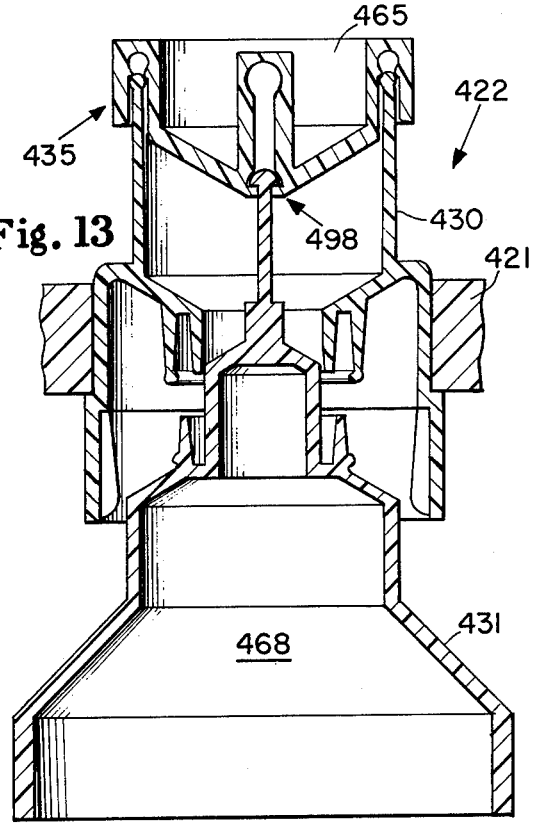

To place a dispenser comprising valve 422 in operation, the user would preferably hold the dispenser upright, FIG. 10 (inverted); then pull upwardly on the moveable component 431 to extend the length of the moveable component 431 to its operating length, FIG. 11 (inverted). which action releases the outer shipping seal 433*a*; then, the user would push downwardly on the moveable component 431 to release the inner shipping seal 433*b*, FIG. 12 (inverted); then pull the movable component 431 to the position shown in FIG. 13 (inverted) being careful not to latch the inner shipping seal 433*b;* and finally the user would invert the dispenser and secure it in a toilet tank as shown in FIG. 2. While being so oriented and secured, the moveable component would be buoyed it its UP position, FIG. 12. The moveable component 431 would then alternately gravitate from its UP position, FIG. 12, to its DOWN position, FIG. 13, and then be buoyed back to its UP position, FIG. 12.

Alternatively, toilet-tank-additive dispensers and the like comprising dosing valve embodiments of the present invention can be activated by first orientating them and securing them in their operating positions, FIG. 2, and by then unlatching any shipping seals incorporated therein. Moreover, means (not shown) can be provided for refilling such dispensers without removing them from their operating environments.

While several dosing valve constructions embodying the present invention have been shown in the figures and described in this specification it is not intended to thereby limit the present invention because it is believed that it would be obvious to those skilled in the art that various other changes and modifications can be made without departing from the spirit and scope of the invention. Therefore, it is intended to cover in the appended claims all such changes and modifications that are within the scope of this invention.

What is claimed is:

1. An improved dosing valve having a stationary member and a moveable component for dispensing a metered dose of a liquid product from a substantially rigid reservoir containing a quantity of a liquid product, said moveable component being axially moveable manually upwardly and moveable downwardly by gravity between an UP position and a DOWN position respectively, said improvement comprising means for forming an air-lock seal between cooperating portions of said stationary member and said moveable component for independently obviating flow from said reservoir when said moveable member is disposed at said DOWN position, and means forming an other seal intermediate other cooperating portions of said stationary member and said movable component for independently obviating flow from said dosage valve when said moveable component is disposed at said UP position, and means including a dose chamber cooperatively associated with said air-lock seal and said other seal for metering and dispensing a said metered dose of said liquid product each time said moveable component gravitates downwardly from said UP position to said DOWN position, and for metering a dose-volume of air upwardly into said reservoir each time said moveable component is moved upwardly from said DOWN position to said UP position.

2. An improved dosing valve having a stationary member and a moveable component for dispensing a metered dose of a liquid product from a substantially rigid reservoir containing a quantity of a liquid product, said moveable component being axially moveable manually upwardly and moveable downwardy by gravity between an UP position and a DOWN position respectively, said improvement comprising means for forming a first air-lock seal and a second air-lock seal intermediate said stationary member and said moveable component when said moveable component is disposed at said DOWN and said UP positions respectively, and means including a dose chamber cooperatively associated with said first air-lock seal and said second air-lock seal for metering and dispensing a said metered dose of said liquid product each time said moveable component gravitates downwardly from said UP position to said DOWN position, and for metering a dose-volume of air upwardly into said reservoir each time said moveable component is moved upwardly from said DOWN position to said UP position.

3. The improved dosing valve of claim 2 wherein said stationary member comprises a tubular portion having a top end and a bottom end, and means for defining an annular-shape vault adjacent said bottom end, and wherein said moveable component comprises an upper end and a lower end interconnected by an axially extending stem, said upper end having a downwardly facing annular U-shape channel formed in it which channel is adapted to telescope downwardly over the top end of said tubular portion of said stationary member to define said first air-lock seal, and said lower end having a tubular section extending upwardly to define an upwardly facing annular U-shape channel, said tubular section being adapted to telescope upwardly into said vault of said stationary member to define said second air-lock seal.

4. The improved dosing valve of claim 3 wherein said top end, said bottom end, said vault and said channels have sufficient axial lengths that said air-lock seals have overlapping sealing ranges for providing make-before-break action which assures isolation of a said metered dose in said dose chamber from the remainder of said liquid product disposed in said reservoir before said metered dose is dispensed.

5. The improved dosing valve of claim 3 wherein said moveable component comprises means for being buoyed upwardly to said UP position by immersing a portion of said moveable component in a second liquid whereby said valve will dispense a metered dose of said liquid product from said reservoir each time the level of said second liquid recedes sufficiently to enable said moveable component to gravitate to said DOWN position.

6. The improved dosing valve of claim 5 wherein said top end, said bottom end, said vault and said channels have sufficient axial lengths that said air-lock seals have overlapping sealing ranges for providing make-before-break action which assures isolation of a said metered dose in said dose chamber from the remainder of said liquid product dispensed in said reservoir before said metered dose is dispensed.

7. The improved dosing valve of claim 3 wherein said stationary member and said moveble component further comprise releasably latchable contacting sealing means for sealingly latching said stationary member with said moveable component by applying an axially directed force on said moveable component greater than the weight of said moveable component to provide a shipping seal, and for unlatching said shipping seal by applying an oppositely directed force on said moveable component.

8. The improved dosing valve of claim 7 wherein said top end, said bottom end, said vault and said channels have sufficient axial lengths that said air-lock seals have overlapping sealing ranges for providing make-before-break action which assures positive isolation of a said metered dose in said dose chamber from the remainder of said liquid product disposed in said reservoir before said metered dose is dispensed.

9. The improved dosing valve of claim 7 wherein said moveable component comprises means for being buoyed upwardly to said UP position by immersing a portion of said moveable component in a second liquid whereby said valve will dispense a metered dose of said liquid product from said reservoir each time the level of said second liquid recedes sufficiently to enable said moveable component to gravitate to said DOWN position.

10. The improved dosing valve of claim 9 wherein said top end, said bottom end, said vault and said channels have sufficient axial lengths that said air-lock seals have overlapping sealing ranges for providing make-before-break action which assures positive isolation of a said metered dose in said dose chamber from the remainder of said liquid product disposed in said reservoir before said metered dose is dispensed.

11. The improved dosing valve of claim 7 wherein said moveable component comprises a top part and a bottom part which comprise means for being telescoped relative to each other to provide a relatively short shipping-length and a relatively long dispensing-length, said parts further comprising means for lengthening said moveable member from said shipping-length to said dispensing-length by pulling outwardly on said bottom part, and for then unlatching a said shipping seal by pushing inwardly on said bottom part.

12. The improved dosing valve of claim 11 wherein said top end, said bottom end, said vault and said channels have sufficient axial lengths that said air-lock seals have overlapping sealing ranges for providing make-before-break action which assures positive isolation of a said metered dose in said dose chamber from the remainder of said liquid product disposed in said reservoir before said metered dose is dispensed.

13. The improved dosing valve of claim 11 wherein said moveable component comprises means for being buoyed upwardly to said UP position by immersing a portion of said moveable member in a second liquid whereby said valve will dispense a metered dose of said liquid product from said reservoir each time the level of said second liquid recedes sufficiently to enable said moveable component to gravitate to said DOWN position.

14. The improved dosing valve of claim 13 wherein said top end, said bottom end, said vault and said channels have sufficient axial lengths that said air-lock seals have overlapping sealing ranges for providing make-before-break action which assures positive isolation of a said metered dose in said dose chamber from the remainder of said liquid product disposed in said reservoir before said metered dose is dispensed.

* * * * *